US006519434B2

(12) United States Patent
Izumi et al.

(10) Patent No.: US 6,519,434 B2
(45) Date of Patent: Feb. 11, 2003

(54) IMAGE FORMING APPARATUS

(75) Inventors: Takao Izumi, Kanagawa-ken (JP); Shinji Aoki, Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/898,465

(22) Filed: Jul. 5, 2001

(65) Prior Publication Data

US 2003/0007807 A1 Jan. 9, 2003

(51) Int. Cl.[7] ..... G03G 15/01; G03G 15/08
(52) U.S. Cl. ..... 399/223; 399/53; 399/228
(58) Field of Search ..... 399/223, 228, 399/229, 270, 277, 53, 54

(56) References Cited

U.S. PATENT DOCUMENTS

| | | | | |
|---|---|---|---|---|
| 4,801,966 A | * | 1/1989 | Ikeda | 399/228 |
| 4,939,547 A | * | 7/1990 | Miyaji et al. | 399/228 |
| 5,063,412 A | * | 11/1991 | Hirsch | 399/229 |
| 5,172,168 A | * | 12/1992 | Satoh et al. | 399/223 X |
| 5,440,377 A | * | 8/1995 | Izawa et al. | 399/223 X |
| 6,102,841 A | * | 8/2000 | Genovese | 399/277 X |

FOREIGN PATENT DOCUMENTS

| | | | |
|---|---|---|---|
| JP | 62-102261 | * | 5/1987 |
| JP | 05-241433 | | 9/1993 |
| JP | 06-138744 | | 5/1994 |
| JP | 06-161254 | * | 6/1994 |
| JP | 08-262841 | | 10/1996 |

* cited by examiner

*Primary Examiner*—Sophia S. Chen
(74) *Attorney, Agent, or Firm*—Foley & Lardner

(57) ABSTRACT

In an image forming apparatus that is capable of forming a color image by bringing plural one-component developing devices in contact with a photosensitive belt, a two-component developing device for black image forming is arranged to face the photosensitive belt in an area wherein the belt is not displaced. By controlling this two component developing device in either the ready to developing state or the non-developing state, when forming a color image, the one-component developing devices are brought in contact with or separated from the photosensitive belt and when forming a monochrome image, using the two-component developing device, a developing nip is formed for the developing gap between the developing device and the photosensitive belt by the developer layer, and a black toner image is formed on the photosensitive belt.

24 Claims, 10 Drawing Sheets

( TABLE 1 )

| | ARRANGING ANGLE ( FROM MAIN POLE CLOCKWISE ROTATION )( DEGREE ) | SURFACE MAGNETIC FLUX DENSITY (mT) |
|---|---|---|
| N1 (PERMANENT MAGNET) (MAIN POLE) | 0 | 1000 |
| S2 (PERMANENT MAGNET) | 60 | 550 |
| N2 (PERMANENT MAGNET) | 210 | 400 |
| S1 (PERMANENT MAGNET) | 290 | 550 |

FIG.5

( TABLE 2 )

| AB-BC [mm] | 3 | 1 | 0 | -1 | -3 |
|---|---|---|---|---|---|
| UNEVEN ON HALF-TONE IMAGE | ○ | ○ | ○ | △ | × |

( TABLE 3 )

| | ARRANGING ANGLE ( FROM MAIN POLE CLOCKWISE ROTATION )( DEGREE ) | SURFACE MAGNETIC FLUX DENSITY (mT) |
|---|---|---|
| N1 (PERMANENT MAGNET) (MAIN POLE) | 0 | 1000 |
| S2 (PERMANENT MAGNET) | 60 | 550 |
| N2 (PERMANENT MAGNET) | 210 | 400 |
| N3 (ELECTROMAGNET) | 240 | 400 OR 0 |
| S1 (PERMANENT MAGNET) | 290 | 550 |

( TABLE 4 )

| | ARRANGING ANGLE ( FROM MAIN POLE CLOCKWISE ROTATION )( DEGREE ) | SURFACE MAGNETIC FLUX DENSITY (mT) |
|---|---|---|
| N1 (PERMANENT MAGNET) (MAIN POLE) | 0 | 1000 |
| S2 (PERMANENT MAGNET) | 60 | 550 |
| NS3 (ELECTROMAGNET) | 210 | 400 ( N OR S ) |
| S1 (PERMANENT MAGNET) | 290 | 550 |

IMAGE FORMING APPARATUS

BACKGROUND OF THE INVENTION

1. Field of the Invention

The present invention relates to an image forming apparatus such as electro-photographic apparatus, printers, etc. for forming developing images on a belt-shaped photoconductor by non-magnetic one-component contact developing devices or a two-component developing device.

2. Description of the Related Art

In recent years color image forming apparatus such as color multifunction peripheral (hereinafter abbreviated to MFP) with a color copying machine, a color printed or further, a facsimile function incorporated into one unit has been in wide use. In offices equipped with such color image forming apparatus, both of conventional monochrome image forming apparatus such as monochrome copying machines, printer, etc. and color image forming apparatus are installed in many cases. However, in order to further promote wide use of color image forming apparatus in the future, it is necessary to reduce a space required for installing a color image forming apparatus so that it can be used in small offices that have a limited space and the development of a practically usable image forming apparatus for color image forming having the performance equivalent to a conventional monochrome image forming apparatus in one unit is demanded.

As an image forming apparatus capable of forming color images, a color image forming apparatus to obtain a full color image by forming yellow (Y), magenta (M), cyan (C) and black (K) toner images in order on a photosensitive belt using non-magnetic one-component contact developing devices, and then superposing these toner images on the photosensitive belt or an intermediate transferring drum and collectively transferring them on a recording paper as disclosed on Japanese Laid-Open Patent Application No. Kai-Hei 6-138744 has been used widely. That is, in a color image forming apparatus, as plural developing devices are provided for respective toner colors and maintenance frequency of the developing devices will increase accordingly, non-magnetic one-component contact developing devices having high user maintainability are used for easy exchange of developing devices and toners by user.

However, a higher cost is required per image for the image forming using non-magnetic one-component contact developing devices and when such non-magnetic one-component contact developing devices are used for the monochrome image formation that consumes much black (K) toner only, a cost per image becomes higher than that of a conventional monochrome image forming apparatus and it becomes not economical.

So, the development of an image forming apparatus has been so far desired, which is equipped with a color image forming apparatus and a monochrome image forming apparatus in one unit and requires a small space for installation, with a priority given over maintainability in the color image formation and reduction of cost per image in the monochrome image forming and with the performance equivalent to that of a conventional monochrome image forming apparatus including economy as well as quality of image.

SUMMARY OF THE INVENTION

An object of this invention is to reduce a space for installing a color image forming apparatus and a monochrome image forming apparatus in offices.

Further, another object of this invention is to achieve the monochrome image formation at a cost nearly equal to an image forming cost of a conventional monochrome image forming apparatus using a color image forming apparatus equipped with the monochrome image forming function.

According to this invention, an image forming apparatus is provided. This image forming apparatus comprises: an image carrier that travels endlessly; plural supporting members supporting the image carrier so that it is able to travel; a latent image forming portion for forming a latent image on the image carrier; a first developing device having first developing members that contact the image carrier after passing the latent image forming portion and form a developed image by supplying developers to the latent image; and a second developing device having a second developing member that is facing the image carrier after passing the latent image forming portion with a prescribed gap and forming a developed image by supplying developers to the latent image.

Further, according to this invention, an image forming apparatus is provided. This image forming apparatus comprises: a belt-shaped photo-conductor; plural roller members supporting the photo-conductor so that it is able to travel; a latent image forming portion for forming a latent image on the photo-conductor; a non-magnetic one-component contact developing device having a first developing member for forming a developing image by supplying non-magnetic one-component developer to the latent image by contacting the photo-conductor after passing the latent image forming portion; and a two-component developing device having a second developing member that is facing to the photo-conductor at a prescribed gap in an area supported by one of the plural rollers after passing the latent image forming portion for forming a developing image by supplying two-component developer to the latent image.

BRIEF DESCRIPTION OF THE DRAWINGS

FIG. 5 is Table 1 showing the arrangement and magnetic flux density of a permanent magnet f a magnet roller in the first embodiment of the present invention;

DETAILED DESCRIPTION OF THE PREFERRED EMBODIMENT

Figure 1:
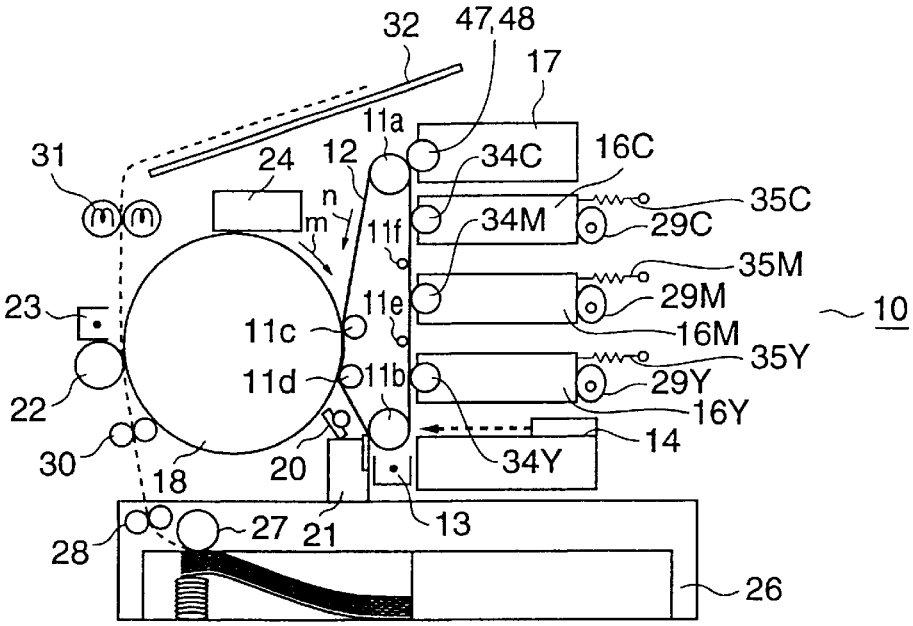
FIG. 1 is a schematic diagram showing an image forming apparatus in a first embodiment of the present invention.

Preferred embodiments of the present invention will be described below in detail referring to the attached drawings. First, a first embodiment of this invention will be described. FIG. 1 is a schematic diagram showing an image forming apparatus 10; a color printer, etc. in the first embodiment of this invention. The image forming apparatus 10 is provided with a photosensitive belt 12 which is an image carrier put over a driving roller 11*a* and a driven roller 11*b* and is backed up by a transferring back-up rollers 11*c*, 11*d* and developing back-up rollers 11*e*, 11*f*. The photosensitive belt 12 is made of a polyethylene terephthalate (PET) with a photosensitizer coated on its surface, its back surface is grounded at OV and is traveled in the arrow direction n.

Around the photosensitive belt 12, there are a charger 13 for uniformly charging the photosensitive belt 12 to about −600V according to its traveling direction and an exposing device 14 that is a latent image forming portion for forming a latent image on the charged photosensitive belt 12. At the positions opposite to the photosensitive belt 12 that is put over from the driven roller 11*b* to the driving roller 11*a*, one-component developers 16Y, 16M, 16C which are first developers filled with 3 color non-magnetic one-component developing toners; Yellow (Y), Magenta (M) and cyan (C) are arranged.

At the position opposite to the photosensitive belt 12 in the area wherein the back of the belt 12 is wound round and supported by a driving roller 11*a* that is a supporting member, a two-component developing device 17 is arranged. This device is a second developing device and filled with a two-component developer 17*a* that is composed of a magnetic carrier and a non-magnetic black (K) toner that is a two-component developer. In addition, at the downstream side in the rotating direction of the photosensitive belt 12, an intermediate transferring drum 18 that is rotated in the arrow direction m, a charge eliminating lamp 20 and a cleaning device 21 are arranged.

The exposing device 14 forms a latent image on the photosensitive belt 12 by applying the laser beam corresponding to writing signals for respective colors according to image information that is input from external computer terminals, etc. At this time, the laser beam emitted from the exposing device 14 is applied to the photosensitive belt 12 in the area wherein its back is wound round and supported by the driven roller 11*b* and stably traveled.

The intermediate transferring drum 18 forms a nip with the photosensitive belt 12 between the transferring back-up rollers 11*c*, 11*d* for the intermediate transferring of a toner image. Around the intermediate transferring drum 18, a secondary transferring roller 22 for secondary transferring a toner image transferred from the photosensitive belt 12 on a recording paper, a separation charger 23 for separating a recording paper and a drum leaner 24 are arranged.

Under the image forming apparatus 10, a paper feed cassette 26 containing recording paper is arranged, and between the paper feed cassette 26 and the secondary transferring roller 22, there are arranged a pick-up roller 27 for taking out recording paper from the paper feed cassette 26, a conveying roller 28 for conveying taken out recording paper to the secondary transferring position, and an aligning roller 30. Further, at the downstream side of the secondary transferring roller 22, a heat roller 31 and a paper exit portion 32 are provided.

Figure 2:
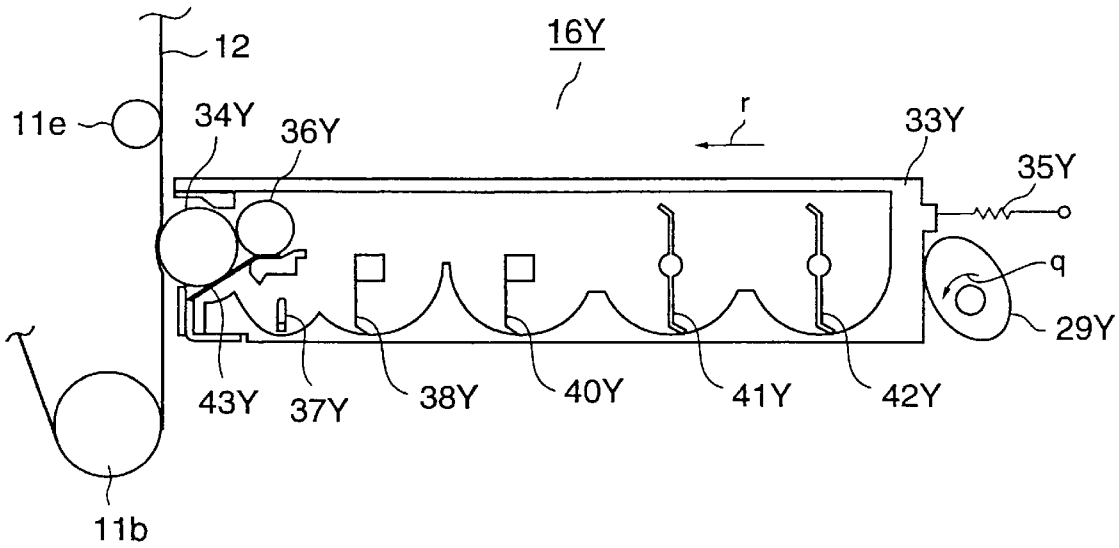
FIG. 2 is a schematic diagram showing a one-component developing device of yellow (Y) in the first embodiment of the present invention.

Next, the one-component developers 16Y–16C will be described. Three one-component developers 16Y–16C in respective colors are all in the same structure although colors of filled toners differ each other. So, these developers will be described referring to the yellow (Y) one-component developer 16Y and other one-component developers 16M, 16C will be assigned with the same symbols and subscripts showing respective colors and their explanations will be omitted. As shown in FIG. 2, the one-component developer 16Y has a developing roller 34Y that is a first developing member to contact the photosensitive belt 12 and supply a toner when developing an image and a toner supply roller 36Y to supply a toner to the developing roller 34Y at the opening side of the housing 33Y. Under the toner supply roller 36Y, a scraping blade 37Y is provided to scrape a toner and behind the toner supply roller 36Y, conveying blades 38Y, 40Y, 41Y 42Y are provided for conveying toners to the toner supply roller 36Y side.

For the developing roller 34Y, such metal rods, tubes, as, for example, aluminum, brass, stainless steel are suited. In this embodiment, the sand blasting process roughens the surface of an aluminum tube in outer diameter ø 18 and desired roughness (normally, Rx=2~3$\mu$) is given. The toner supply roller 36Y is made of about ø 13.4 foamed urethane and resistance is given with conductivity of about $10^3$.

A toner layer control blade 43Y is kept in contact with the surface of the developing roller 34Y. This toner layer control blade 43Y is made of a 0.1 mm thick stainless steel leaf spring. The surface of this blade is coated with urethane rubber or silicone rubber resin about 100 $\mu$m thick to control the toner layer thickness so as to charge toner supplied from the toner supply roller 36Y satisfactorily and form a uniform thin toner layer on the developing roller 34Y. The pressure applied to the developing roller 34Y of the toner layer control blade 43Y is 95 kgf/cm.

The scraping blade 37Y is a wire shape blade to rub the curved surface of the bottom of housing 33. The transferring blades 38Y, 40Y have a Mylar sheet pasted to the shaft. The conveying blade 41Y, 42Y have a Mylar sheet pasted at 2 points (apart each other by 180°) on the shaft. Respective Mylar sheets convey toners in the direction of the toner supply roller 36Y while rubbing the curved surface of the housing 33. Mylar is polyester where ethylene glycol and terephthalic acid are made to condense.

Figure 3:
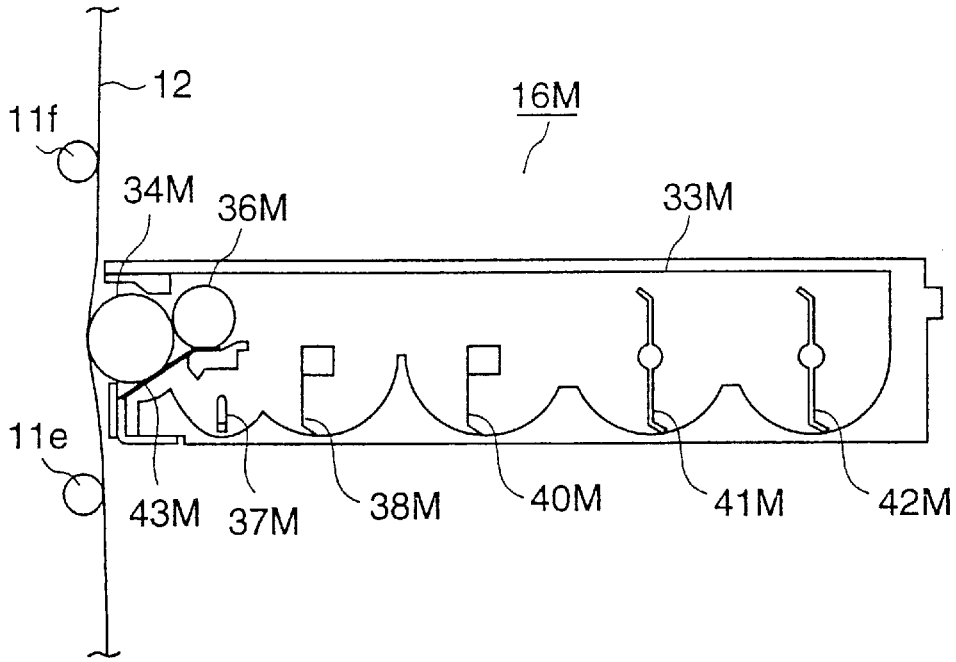
FIG. 3 is a diagram for explaining the contact of a one-component developing device of magenta (M) in the first embodiment of the present invention.

The one-component developing devices 16Y–16C are able to slide and move along guides (not shown) by eccentric cams 29Y, 29M, 29C and springs 35Y, 35M, 35C. When not developing an image, the one-component developing device 16Y–16C are separated from the photosensitive belt 12 by the force of the springs 35Y–35C and when developing an image, slide and move against the springs 35Y–35C by the eccentric cams 29Y–29C which are rotated when necessary and bring one of the developing rollers 34Y–34C in contact with the photosensitive belt 12. The yellow (Y) developing roller 34Y bites into the surface of the photosensitive belt 12 by about 0.5 mm when contacting the photosensitive belt 12, and forms a nip of 2–3 mm between the driven roller 11*b* and the developing backup roller 11*e*. Similarly, the magenta (M) developing roller 34M forms a nip of 2–3 mm between the developing back-up rollers 11*e* and 11*f* when contacting the photosensitive belt 12, and the cyan (C) developing roller 34C forms a nip of 2–3 mm between the developing back-up roller 11*f* and the driving roller 11*a* when contacting the photosensitive belt 12 as shown in FIG. 3.

Figure 4:
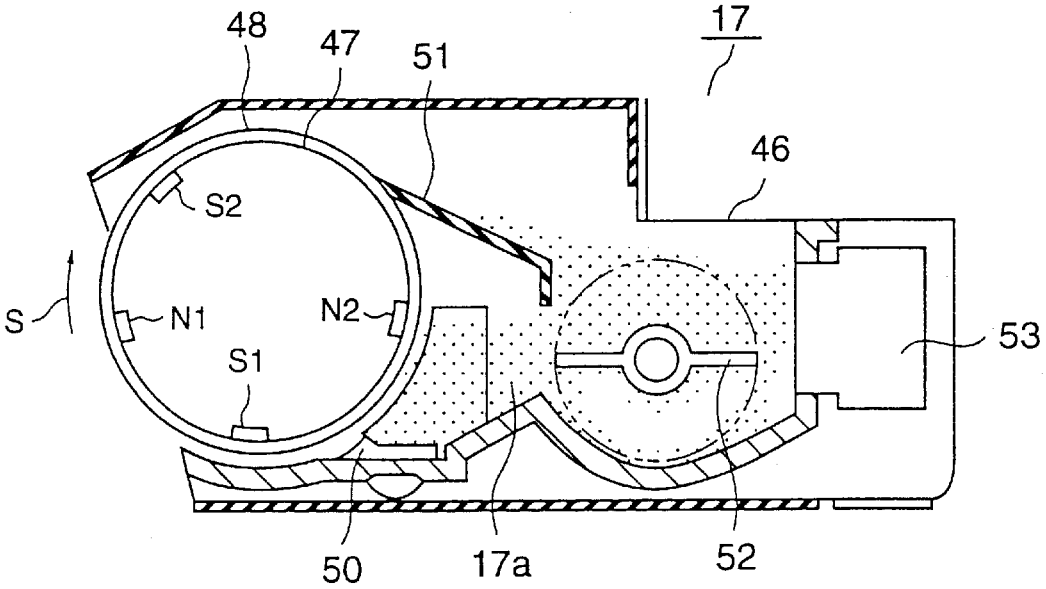
FIG. 4 is a schematic diagram showing a two-component developing device in the first embodiment of the present invention.

Next, the two-component developing device 17 will be described. As shown in FIG. 4, the two-component developing device 17 is a second developing portion to supply a black (K) toner at the opening side of the housing 46 and has a developing sleeve 48 in radius of curvature 15 mm that rotates around the magnet roller 47. Around the developing sleeve 48, there are provided a doctor blade 50 for controlling a height of developer layer formed on the developing sleeve 48 and a separator 51 for recovering a developer after completing the development, and behind the developing sleeve 48, there are provided a stirring/conveying portion 52 for supplying a developer to the developing sleeve 48 and furthermore, an automatic toner sensor 53 for measuring toner density for controlling supply of toner from a toner hopper (not shown). The magnet roller 47 comprises an N1 (the main pole), S2, N2 and S1 permanent magnets having an arranging angle and a surface magnetic flux density shown in FIG. 5 (Table 1), respectively.

The two-component developing device 17 is slid and moved along the guide (not shown) on the back of the housing 46 in the direction of the photosensitive belt 12 by a sliding spring 55 and a sliding device 56 so that a gap between the developing sleeve 48 and the photosensitive belt 12 comes close to the ready to developing state or is separated to the non-developing state.

Figure 6:
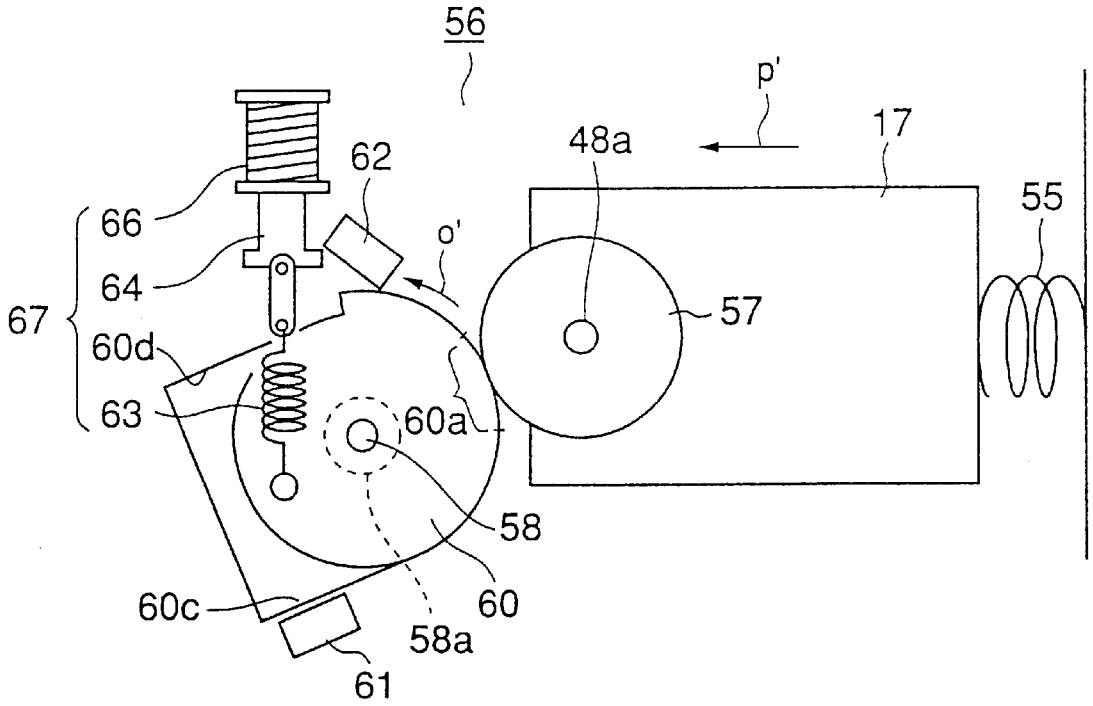
FIG. 6 is an explanatory diagram briefly showing a sliding device of the two-component developing device in the first embodiment of the present invention is in the ready to developing state.

The sliding device 56 is shown in FIG. 6. At both ends of a shaft 48*a* of the developing sleeve 48 of the two-component developing device 17, a guide roller 57 is proved. This roller is a second positioning portion formed in a radius of curvature 15.04 mm (a radius of curvature of the developing roller 15 mm+ a developing gap 0.04 mm) larger than that of the developing sleeve 48 by a developing gap is provided. Further, at both ends of a shaft 58 of the driving roller 11*a* at the outside of the portion on which the photosensitive belt 12 is put, a cam member 60 is provided. This cam member 60 is a first positioning member kept in contact with the guide roller 58 and is able to rotate freely together with the shaft 58 via a bearing 58*a*.

The cam 60 has a developing position surface 60*a*. This surface 60*a* is a first reference plane in a radius of curvature 17.1 mm (a radius of curvature of the driving roller 11*a*+ a thickness 0.1 mm of the photosensitive belt 12), which is the same surface as that of the photosensitive belt 12, supported by the driving roller 11*a*. The cam member 60 also has a separating position surface 60*b* of which radius of curvature becomes large gradually from the developing position surface 60*a* to the maximum 22.1 mm. Further, the cam member 60 has a first locking portion 60*c* that contacts a first stopper 61 to stop the cam member 60 at a position where the developing surface 60a comes to contact a guide roller 57 and a second locking portion 60*d* that contacts a second stopper 62 to stop the cam member 60 at a position where the maximum radius of curvature of the separating surface 60*b* comes to contact the guide roller 57.

Further, the sliding device 56 has a separation operator pair comprising compression springs 63, operating rods 64 and solenoids 66. To separate the two-component developing device 17 from the photosensitive belt 12, the separation operator pair 67 turns on the solenoids 66 at both sides at the same timing, extends the compression springs 63, rotates the cam member 60 in the arrow direction o, and when the second locking portion 60*d* runs against the second stopper 62, stops the cam member 60 to rotate. As a result, the portion of the maximum radius of curvature of the cam member 60 contacts the guide roller 57, the two-component developing device 17 is slid in the arrow direction p against the sliding spring 55, the gap between the developing sleeve 48 and the photosensitive belt 12 becomes about 5 mm, and the two-component developing device 17 comes in the non-developing state.

When the solenoids 66 of the separation operating portion 67 are turned OFF, the cam member 60 turns in the direction o' opposite to the arrow direction o by the compression force of the compressing spring 63 as shown in FIG. 6, and when the first locking portion 60*c* runs against the first stopper 61, the cam member 60 is stopped to rotate. As a result, the developing position surface 60*a* of the cam member 60 is brought in contact with the guide roller 57, the two-component developing device 17 is slid in the direction p' that is reverse to the arrow direction p by the sliding spring 55, a gap between the developing sleeve 48 and the photosensitive belt 12 becomes close to 0.04 mm that is a developing gap and the two-component developing device 17 becomes the ready to developing state.

Thus, when developing images, the two-component developing device 17 maintains the gap between the developing sleeve 48 and the photosensitive belt 12 close to the 0.04 mm developing gap and when not developing images, separates the gap between the developing sleeve 48 and the photosensitive belt 12 to about 5 mm.

On the other hand, in order to maintain the gap between the developing sleeve 48 and the photosensitive belt 12 at close to 0.04 mm at the time of development, it becomes an important factor not to have the photosensitive belt 12 flutters when running. So, to examine the relationship of the developing position of the developing sleeve 48, the nip width between the developing position and the photosensitive belt, and quality of developed image, developing tests were conducted at a position where the photosensitive belt 12 is wound round and supported by the driving roller 11*a* with the position of the two-component developing device 17 opposite to the photosensitive belt 12 shifted, and the results on (Table 2) shown in FIG. 9 were obtained.

Figures 8, 9:
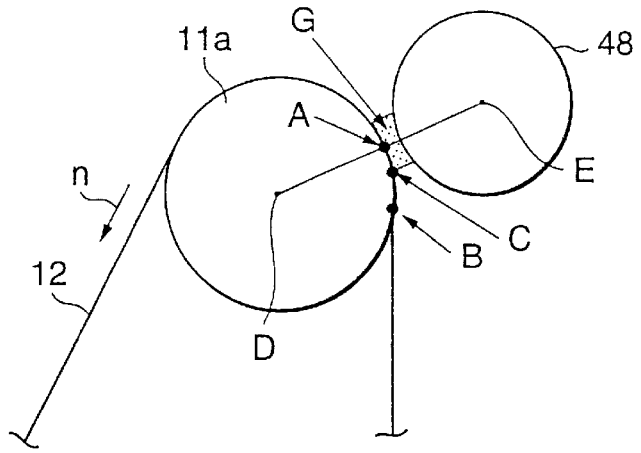
FIG. 8 is an explanatory diagram showing the nipping relation between the developing position of the two-component developing device and the photosensitive belt in the first embodiment of the present invention.
FIG. 9 is Table 2 showing the results of investigation conducted on developed image quality affected by the change in the developing position of the two-component developing device in the first embodiment of the present invention.

As shown in FIG. 8, with the two-component developing device 17 and the photosensitive belt 12 faced each other, a point of a straight line connecting the center D of the driving roller 11*a* with the center E of the developing sleeve 48 crossing the surface of the photosensitive belt 12 is assumed to be A, a point on the surface of the photosensitive belt 12 starting to wind round the driving roller 11*a* is B, and a boundary point of the nip G between the developer layer on the developing sleeve 48 and the photosensitive belt 12, which is the boundary point from Point A at the upper stream side of the photosensitive belt 12 in the conveying direction of the arrow mark n is C. By shifting the position of the two-component developing device 17 to AB−BC=3 mm, 1 mm, 0 mm, −1 mm and −3 mm, the quality of developed image was compared. However, the boundary point C of the nip G was judged from the boundary line of toner adhered to the photosensitive belt 12 in a strip shape when developing sleeve 48 was rotated with the photosensitive belt 12 stopped.

As a result, up to AB−BC=0–3 mm, good developed images could be obtained but in the case of AB−BC=−1 mm, a strip-shaped uneven density was visually observed slightly on a half-tone image. That is, when the position of the nip G comes off the area wherein the back of the photosensitive belt 12 completely wind round the driving roller 11*a* and closely fitted and comes into the area wherein the back of the photosensitive belt 12 is not fitted to and supported by the driving roller 11*a,* the density becomes uneven on a half-tone image and the quality of image is lowered.

When the displacement of the photosensitive belt 12 in the normal line direction was measured using a laser displacement meter in the area wherein the back of the photosensitive belt 12 is not supported by the driving roller 11*a,* a displacement larger than the area wherein the belt wound round the driving roller 11*a* completely was observed and it was disclosed that the photosensitive belt 12 fluttered and a strip-shaped uneven density was produced. From the above result, to obtain a satisfactorily developed image without uneven density, it is adequate to make the development in the area wherein the photosensitive belt 12 winds round the driving roller 11*a* completely and its back is fitted closely to and supported by the driving roller 11*a*.

Next, the image forming process according to the image forming apparatus 10 will be described. Before starting the image forming, the developing rollers 34Y–34C of the one-component developing device 16Y–16C are separated from the photosensitive belt 12 by the force of the springs 35Y–35C and in the case of the two-component developing device 17, the solenoid is turned ON and the gap between the developing sleeve 48 and the photosensitive belt is maintained at about 5 mm.

When the color image forming process starts in this state, the eccentric cam 35Y for moving the Yellow (Y) one-component developing device 16Y is rotated in the arrow direction q by the driving device (not illustrated). As a result, the one-component developing device 16Y is slid and moved in the arrow direction r and the developing roller 34Y is brought in contact with the photosensitive belt 12 so as to bite it by about 0.5 mm. Then, the photosensitive belt 12 travels in the arrow direction n by the rotation of the driving roller 11*a* and is uniformly charged to −600V by a sequential charger 13 and then, is applied with the laser beam corresponding to the yellow image signal of image signals divided into yellow, magenta, cyan and black by the exposing device 14. As a result, a yellow latent image is formed on the photosensitive belt 12. The yellow latent image formed on the photosensitive belt 12 is developed while passing through the nip between the developing roller 34Y and the photosensitive belt 12 and a yellow toner image is formed on the photosensitive belt 12.

Then, the photosensitive belt 12 reaches the intermediate transferring drum 18 to which about +500V transferring bias is applied and the yellow toner image is intermediately transferred electrostatically on the intermediate transferring drum 18. After the intermediate transfer, the charge elimination lamp 20 eliminates the charge on the surface of the photosensitive belt 12 and the cleaner 21 cleans residual toner.

Thereafter, likewise the yellow toner image forming process described above, the magenta and cyan toner image forming processes are repeated sequentially and the yellow (Y), magenta (M) and cyan (C) toner images are transferred and laminated sequentially on the intermediate transferring drum 18 from the photosensitive belt 12.

Then, for forming a black (K) toner image, by applying the laser beam corresponding to a black image signal, a black image latent image is formed on the photosensitive belt 12. At this time, the developing rollers 34Y–34C of the one-component developing devices 16Y–16C are kept separated from the photosensitive belt 12. On the other hand, in the two-component developing device 17, the developing sleeve 48 is rotated in the arrow direction s to form the developer layer around it, and the doctor blade 50 controls the thickness of the layer. Further, as shown in FIG. 6, the sliding device 56 turns the solenoid 66 OFF, the cam 60 member is rotated by the compression spring 63 in the arrow direction o and the cam member 60 is stopped to rotate when the first locking portion 60*c* runs against the first stopper 61. As a result, the developer position surface 60*a* of the cam member 60 contacts the guide roller 57 and the two-component developing device 17 is slid in the arrow direction p by the sliding spring 55, and the gap between the developing sleeve 48 and the photosensitive belt 12 comes close to a developing gap distance 0.04 mm. Then, the two-component developing device 17 is placed in the ready to developing state by forming a developing nip for the developing gap between the developing sleeve 48 and the photosensitive belt 12 by the developer layer on the developing sleeve 48.

A latent image formed on the photosensitive belt 12 is developed while it passes through the developing gap between the developing sleeve 48 and the photosensitive belt 12 and a black toner image is formed on the photosensitive belt 12. Then, a black (K) toner image formed on the photosensitive belt 12 is intermediately transferred electrostatically on the intermediate transferring drum 18 where yellow (Y), magenta (M) and cyan (C) toner images were already transferred and laminated and a full color toner image is formed on the intermediate transferring drum 18.

Figure 7:
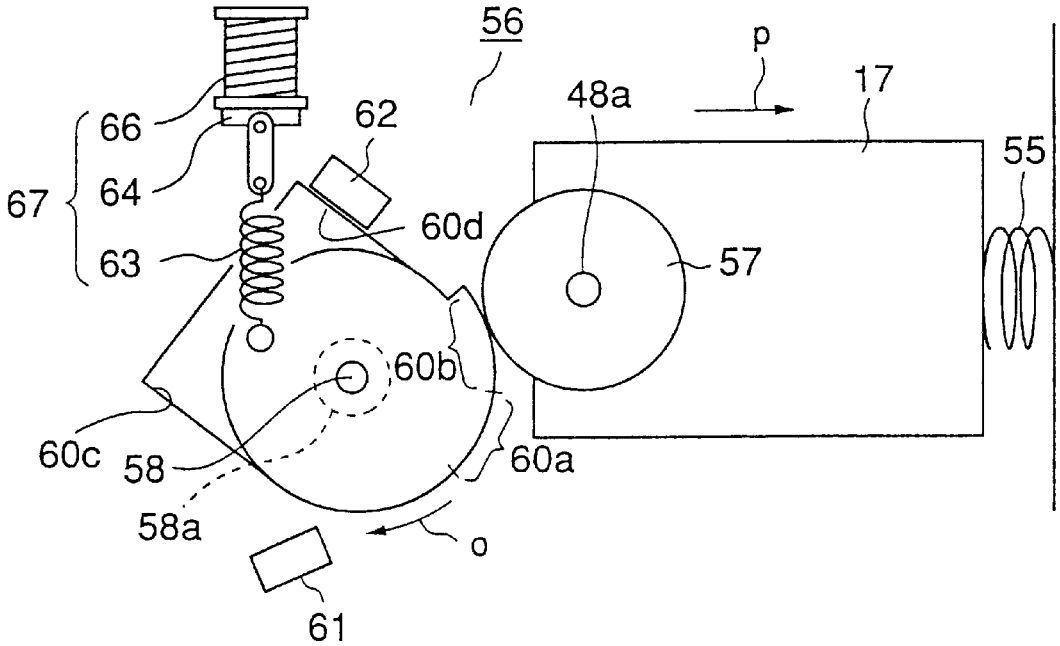
FIG. 7 is an explanatory diagram briefly showing the sliding device of the two-component developing device in the first embodiment of the present invention is in the non-developing state.

After completing the development, as shown in FIG. 7, the sliding device 56 turns the solenoid 66 ON, the cam member 60 is rotated in the arrow direction o by the compression spring 63 and the cam member 60 is stopped to rotate when the second locking portion 60*d* runs against the second stopper 62. As a result, the portion of maximum radius of curvature of the separation position surface 60*b* of the cam member 60 contacts the guide roller 57, the two-component developing device 17 is slid in the arrow direction p against the sliding spring 55, the developing sleeve 48 and the photosensitive belt 12 is separated to a gap of about 5 mm and the two-component developing device 17 is placed in the non-developing state. Thereafter, the developing sleeve 48 is stopped.

The yellow (Y), magenta (M), cyan (C) and black (K) full color toner images formed on the intermediate transferring drum 18 are taken out of the paper supply cassette 26 to which 2–3 kV bias voltage is applied and collectively transferred on a recording paper that is conveyed synchronous with the full color toner images. Thereafter, while the recording paper passes through the heat roller 31, the full color toner images are fixed and ejected on the receiving tray. Thus, the full color image is completed. The intermediate transferring drum 18 is cleaned by removing residual toners by the drum cleaner 24 and becomes ready for a next intermediate transferring process. Thus, for obtaining a color image, the developing operation is carried out using both the one-component developing devices 16Y–16C and the two-component developing device 17.

Next, when forming a monochrome image, it is obtained by executing the above-mentioned black (K) toner image forming process using the two-component developing device 17 only. That is, the solenoid 66 is turned OFF, a gap between the developing sleeve 48 and the photosensitive belt 12 is brought close to the developing gap 0.04 mm, a developing nip is formed by the developer layer on the developing sleeve 48 and the two-component developing device 17 is placed in the ready to developing state. Then, with the travelling of the photosensitive belt 12, while a monochrome latent image formed on the photosensitive belt 12 passes the developing nip formed between the developing sleeve 48 and the photosensitive belt 12, a black toner image is formed on the photosensitive belt 12. Hereafter, the black toner image is transferred on the intermediate transferring drum 18 from the photosensitive belt 12 and then, with the rotation of the intermediate transferring drum 18, the black toner image is transferred directly on a recording paper and after fixed, a monochrome image is completed on the recording paper.

During full color images and monochrome images forming operations according to image information, if exhaust of toners in the housing 33Y–33C is detected by an empty detector (not illustrated) in the one-component developing devices 16Y–16C, the one-component developing devices 16Y–16C are replaced with new developing devices in order of devices emptied by user.

On the other hand, in the two-component developing device 17, while toners are constantly supplied from toner hoppers (not illustrated) according to the measured result of toner density by an automatic toner sensor 53, the toner hoppers are exchanged with new ones when emptied at the user side. During this period, a periodical maintenance is carried out by a service man and when the two-component developing device 17 reaches its span of life, it is exchanged with a new two-component developing device 17. Depending on the difference in this maintainability, the cost of development required per image including the cost of replacement of a developing device using the two-component developing device 17 can be reduced remarkably to a level less than that using one-component developing devices 16Y–16C. Accordingly, a monochrome image developed using the two-component developing device 17 can be manufactured at a cost equivalent to the manufacturing cost of a monochrome image by a conventional exclusive monochrome image forming apparatus.

Using the one-component developing devices 16Y–16C, monochrome half-tone images of Yellow (Y), Magenta (M) and Cyan (C) were formed and a Black (K) monochrome half-tone image was formed using the two-component developing device, and further, a full color image was formed using the one-component developing devices 16Y–16C and the two-component developing device 17 by the image forming apparatus in the first embodiment. As a result, images of good quality without uneven image could be obtained.

According to this first embodiment, in order to form Yellow (Y), Magenta (M) and Cyan (C) color toner images, the one-component developing devices 16Y–16C are provided and to form Black (K) toner image, the two-component developing device 17 is provided. In other words, to form color images, color images can be obtained using the one-component developing devices 16Y–16C and to form monochrome images, monochrome images can be obtained using the two-component developing device 17 at a cheaper developing cost per image including a developing device exchanging cost. Therefore, it becomes possible to reduce a monochrome image forming cost to a similar level of a conventional exclusive monochrome image forming apparatus without deteriorating user maintainability that is demanded as a color image forming apparatus and also to use an image forming apparatus capable of forming color images as a monochrome image forming apparatus. Thus, from a single unit of image forming apparatus 10, a monochrome color forming function as well as a color image forming function can be obtained at almost the same level of low cost and therefore, even for offices in narrow spaces, it becomes easy to introduce an image forming apparatus and it becomes possible to further promote the wide spread use of a color image forming apparatus.

According to this first embodiment, the developing operation by the two-component developing device is executed on the photosensitive belt 12 supported by the driving roller 11*a* in an area that has no fluttering of the belt and therefore, the developing gap between the developing sleeve 48 and the photosensitive belt 12 can be stably maintained at the time of development, a good developing characteristic is obtained and a good image without half tone uneven density can be obtained.

According to this first embodiment, the two-component developing device 17 is slid and moved by the sliding device 56 and at the time of development, the developing gap is correctly controlled and a good developing characteristic is obtained and at the time of the non-development, the developing sleeve 48 is surely separated from the photosensitive belt 12 and therefore, mixing of different color toners can be prevented positively and a clearly developed image of good quality can be obtained.

Next, the second embodiment of the present invention will be described. In this second embodiment, the cam member of the sliding device that is used in the first embodiment is provided at the two-component developer side and the developing sleeve and the photosensitive belt are brought in contact with and separated each other. Accordingly, in this second embodiment the same component elements described in the first embodiment are assigned with the same reference numerals and the detailed explanations will be omitted.

Figure 10:
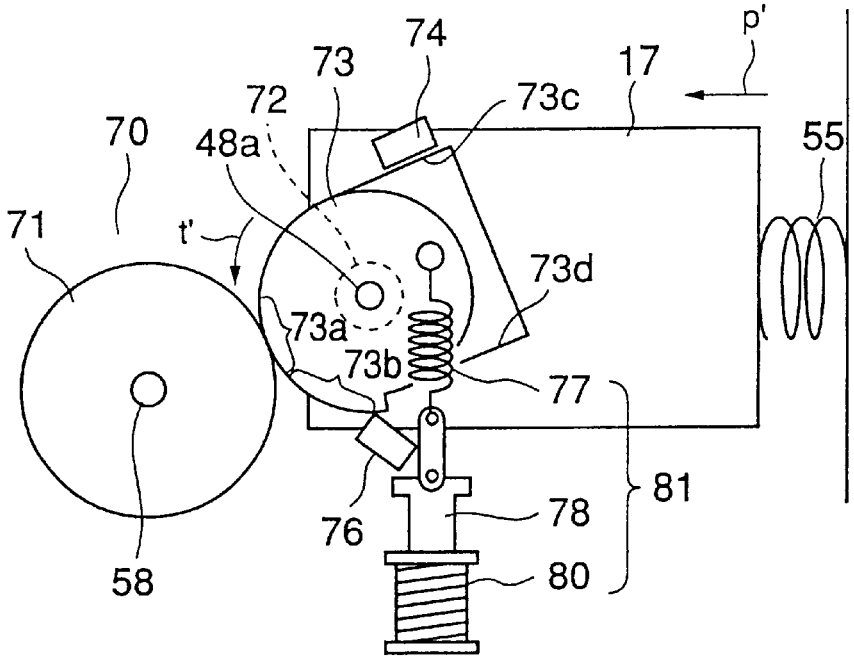
FIG. 10 is an explanatory diagram for briefly showing the sliding device when the two-component developing device is in the ready to developing state in a second embodiment of the present invention.
Figure 11:
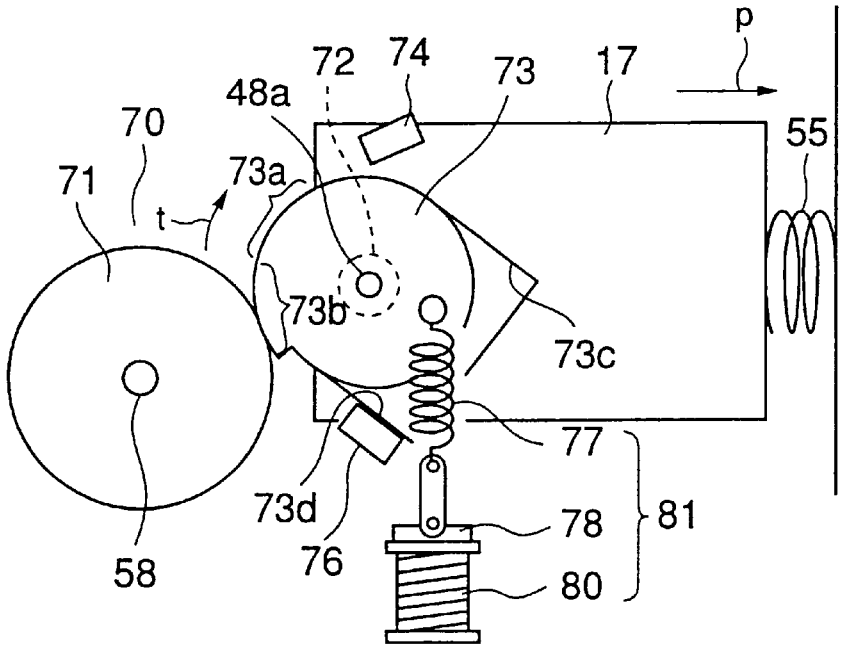
FIG. 11 is an explanatory diagram for briefly showing the sliding device when the two component developing device is in the non-developing state in the second embodiment of the present invention.

A sliding device 70 for sliding and moving the two-component developing device 17 arranged opposing to the photosensitive belt 12 in an area wherein it is supported by the driving roller 11*a* without causing fluttering is shown in FIG. 10. At the outside of the portions at both ends of the shaft 58 of the driving roller 11*a* over which the photosensitive belt 12 is put, there is provided a guide roller 71 which is a first positioning member having a radius of curvature 17.14 mm (the radius of curvature of the driving roller 11*a* 17 mm+ the thickness of the photosensitive belt 12 0.1 mm+ the developing gap 0.04 mm) that is larger than the radius of curvature of the surface of the photosensitive belt 12 supported by the driving roller 11*a* by a development gap. At both ends of the shaft 48*a* of the developing sleeve 48 of the two-component developing device 17, there is provided a cam member 73 that is a second positioning member always kept in contact with the guide roller 71 and is capable of freely rotating with the shaft 48*a* via a bearing 72.

On the cam member 73, a developing position surface 73*a* that is a second reference plane having a radius of curvature 15 mm and becomes the same surface position as the surface of the developing sleeve 48 and a separation position surface 73*b* of which radius or curvature becomes gradually and continuously large to the maximum 20 mm from this developing position surface 73*a* are formed. Further, on the cam member 73, a first locking portion 73*c* that contacts a first stopper 74 that stops the cam member 73 at the position wherein the developing position surface 73*a* contacts the guide roller 71 and a second locking portion 73*d* that contacts a second stopper 76 to stop the cam member 73 at the position where the maximum radius of curvature of the separation position surface 73*b* are formed.

The sliding device 70 has a separation operating portion pair 81 comprising compression spring 77, operating rod 78 and solenoid 80. To separate the two-component developing device 17 from the photosensitive belt 12, the separation operating portion 81 turns ON the solenoid 80 at both sides, extends the compression spring 77, rotate the cam member 73 in the arrow direction t and stop the cam member 73 to rotate when the second locking portion 73*d* runs against the second stopper 76. As a result, the maximum radius of curvature of the cam member 73 is brought in contact with the guide roller 71, the two-component developing device 17 is slid in the arrow direction p against the sliding spring 55, the developing sleeve 48 and the photosensitive belt 12 is separated to a gap of about 5 mm, and the two-component developing device 17 is placed in the non-developing state.

When the solenoid 80 is turned OFF, the cam member 73 is rotated in the arrow direction t' that is opposite to the arrow direction t by the compression force of the compression spring 77 and is stopped to rotate when the first locking portion 73*c* runs against the stopper 74 as shown in FIG. 10. As a result, the developing position surface 73*a* of the cam member 73 is brought in contact with the guide roller 74, the two-component developing device 17 is slid in the arrow direction p' by the sliding spring 55, a gap between the developing sleeve 48 and the photosensitive belt 12 comes close to the developing gap 0.04 mm, and the two-component developing device 17 is placed in the ready to developing state.

Thus, at the time of development, the two-component developing device 17 maintains the gap between the developing sleeve 48 and the photosensitive belt 12 close at the developing gap 0.04 mm and at the time of non-development, separates the developing sleeve 48 and the photosensitive belt 12 to the gap of about 5 mm.

If the black (K) toner image formation is needed at the time of the color image or monochrome image formation by the image forming apparatus 10, the developing rollers 34Y–34C of the one-component developing devices 16Y–16C are separated from the photosensitive belt 12. On the other hand, the developing process is executed by bringing the two-component developing device 17 close to the photosensitive belt 12 so that the gap between the developing sleeve 48 and the photosensitive belt 12 comes close to the developing gap of 0.04 mm. That is, the developer layer is formed around the developing sleeve 48 and as shown in FIG. 10, the solenoid 80 is turned OFF, the cam member 73 is rotated in the arrow. direction t' by the compression spring 77 and the cam member 73 is stopped when the first locking portion 73*c* runs against the first stopper 74. As a result, the developing position surface 73*a* of the cam member 73 is brought in contact with the guide roller 71 and the two-component developing device 17 is slid in the arrow direction p' by the sliding spring 55, the developing sleeve 48 and the photosensitive belt 12 are brought to the developing gap distance 0.04 mm, the developing nip is formed in the developing gap between the developing sleeve 48 and the photosensitive belt 12 by the developer layer on the developing sleeve 48, and the two-component developing device 17 is placed in the ready to developing state. A latent image on the photosensitive belt 12 is developed when it passes through the developing gap between the developing sleeve 48 and the photosensitive belt 12 and a black toner image is formed on the photosensitive belt 12. After completing the development, the solenoid 80 is turned ON, the cam member 73 is rotated in the arrow direction t by the compression spring 77 and the cam member 73 is stopped to rotate when the second locking portion 73*d* runs against the second stopper 76. As a result, the portion of maximum radius of curvature of the cam member 73 is brought in contact with the guide roller 71, the two-component developing device 17 is slid in the arrow direction p against the sliding spring 55, the gap between the developing sleeve 48 and the photosensitive belt 12 is separated to a gap of about 5 mm and the two-component developing device 17 is placed in the non-developing state. Hereafter, the developing sleeve 48 is stopped.

According to this second embodiment, likewise the first embodiment described above, an image forming apparatus that is capable of forming color images and is also usable as a monochrome image forming apparatus for forming monochrome images at a cheap cost per image including a cost required for exchanging a developing device equivalent to a conventional exclusive monochrome image forming apparatus by using the two-component developing device without deteriorating the user maintainability that is regarded preferentially as a color image forming apparatus. Accordingly, a single unit of the image forming apparatus 10 is able to provide the monochrome image forming function at an almost same level of cost as that of a conventional exclusive monochrome image forming apparatus in addition to the color image forming function. Therefore, it is easy for offices in narrow spaces to introduce an image forming apparatus coping with color images and the further spread use of color image forming apparatus can be promoted.

According to this second embodiment, likewise the first embodiment, as the developing position by the two-component developing device is in an area wherein no fluttering of the photosensitive belt 12 is caused, a good developing characteristic resulting from stabilization of a developing gap is obtained and a good image without uneven density can be obtained.

Further, according to this second embodiment, as the two-component developing device 17 is slid and moved by the sliding device 70 and a good developing characteristic is obtained by accurately controlling a developing gap when developing images and the developing sleeve 48 is surely separated from the photosensitive belt 12 when no image is developed, mixture of different color toners is positively prevented and a clearly developed image of good quality is obtained.

Next, a third embodiment of the present invention will be described. The two-component developing device in this third embodiment is in a structure differing from that in the first embodiment and further, a method for switching the ready to developing state and the non-developing state of the two-component developing device differs from that in the first embodiment. Accordingly, in this third embodiment, the same structural elements as those described in the first embodiment will be assigned with the same reference numerals and the detailed explanations of them will be omitted.

Figures 12, 13:
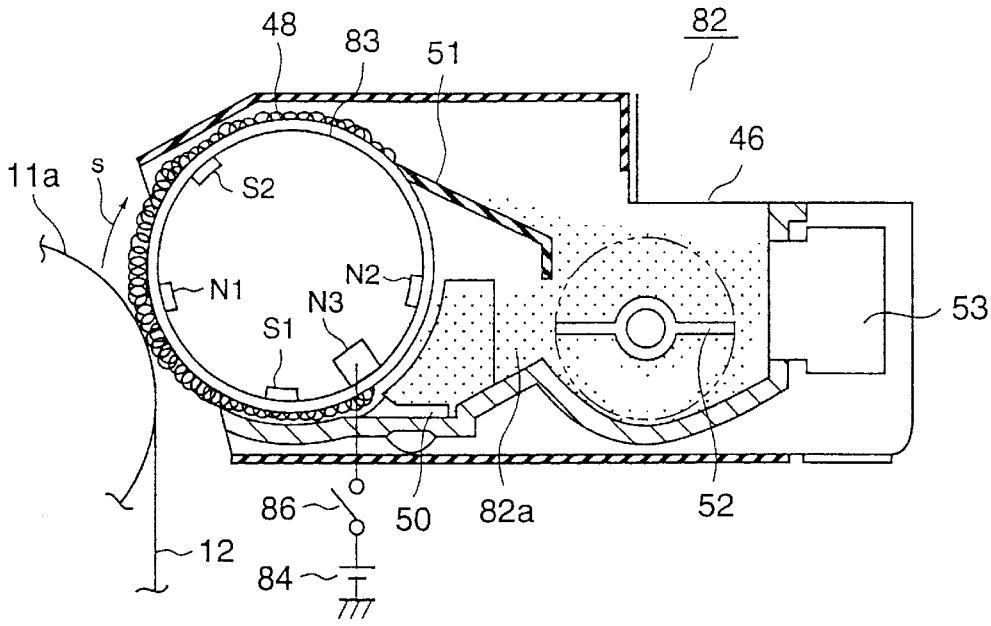
FIG. 12 is an explanatory diagram briefly showing the ready to developing state of the two-component developing device in a third embodiment of the present invention.
FIG. 13 is Table 3 showing the arrangement and magnetic flux density of a magnet of a magnet roller in the third embodiment of the present invention.

A two-component developing device 82 which is filled with a two-component developer 82*a* comprising magnetic carrier and non-magnetic black (K) toner that is a two-component developer shown in FIG. 12 is supported by the driving roller 11*a* likewise the two-component developing device 17 in the first embodiment and faced to the photosensitive belt 12 in an area wherein it does not flutter. The two-component developing device 82 is arranged stationary at the position opposing to the photosensitive belt 12 in the state maintaining a gap between the developing sleeve 48 and the photosensitive belt 12 at the developing gap 0.04 mm. A magnet roller 83 of the two-component developing device 82 has permanent magnets N1 (the main polarity), S2, N2, S1 which have an arranged angle and surface magnetic flux density, respectively shown on (Table 3) in FIG. 13 and between the permanent magnets N2 and S1, an electromagnet N3 that is able to control the switching the surface magnetic flux density to 400 (mT) or zero is provided as shown in (Table 3).

Figure 14:
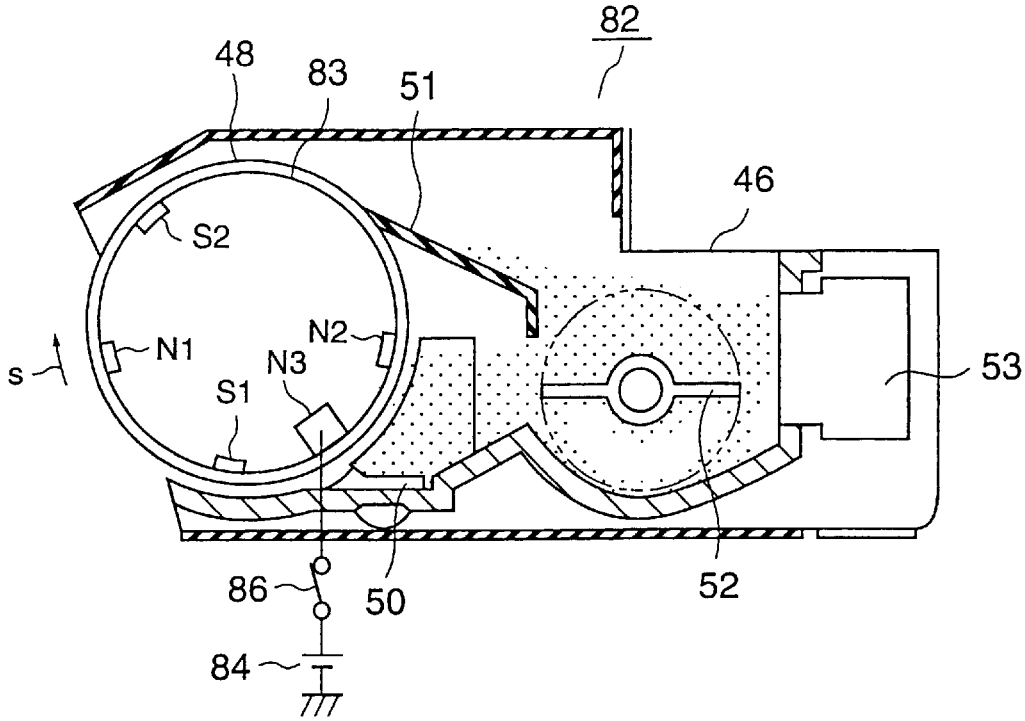
FIG. 14 is an explanatory diagram briefly showing the non-developing state of the two-component developing device in the third embodiment of the present invention.

To place the two-component developing device 82 in the ready to developing state, turn off a switch 86 of a power source 84 to stop supply of electric charge to the electromagnet N3 and reduce the surface magnetic flux density of the electromagnet N3 to zero. When the developing sleeve 48 is driven in the arrow direction s under this state, a developer layer comprising a two-component developer 82*a* is formed as shown in FIG. 12 and the thickness of this developer layer is controlled by the doctor blade 50. To place the two-component developing device 82 in the non-developing state, turn the switch 86 ON and increase the surface magnetic flux density of the electromagnet N3 to 400 (mT) by giving electric charge from the power source 84. Thus, by shutting off the magnetic flux line around the magnet roller 83 between the permanent magnet N2 and the electromagnet N3 and recover the developer layer on the developing sleeve 48 in the housing 46 as shown in FIG. 14.

Then, when the black (K) toner image forming process is executed at the time of the color image forming or the monochrome image forming by the image forming apparatus 10, separate the developing rollers 34Y–34C of the one-component developing devices 16Y–16C from the photosensitive belt 12. In the case of the two-component developing device 82, turn the switch 86 OFF, reduce the surface magnetic flux density of the electromagnet N3 to zero so as to continue the magnetic flux line around the magnet roller 83, form a developer layer around the developing sleeve 48 by rotating the developing sleeve 48 in the arrow direction s, and control the thickness of the developer layer by the doctor blade 50. Then, form a developing nip for the developing gap between the developing sleeve 48 and the photosensitive belt 12 by the developer layer on the developing sleeve 48 and place the two-component developing device 82 in the ready to developing state. A latent image on the photosensitive belt 12 is developed when it passes through the developing gap between the developing sleeve 48 and the photosensitive belt 12 and a black toner image is formed on the photosensitive belt 12.

After completing the development, first turn on the switch 86 and set the surface magnetic flux density of the electromagnet N3 to 400 (mT), shut off the magnetic flux line between the permanent magnet N2 and the electromagnet N3, immediately recover the developer layer on the surface of the developing sleeve 48 in the housing 46, place the two-component developing device 82 in the non-developing state and thereafter, stop the developing sleeve 48 so as to prevent mixture of toner images.

Figure 15:
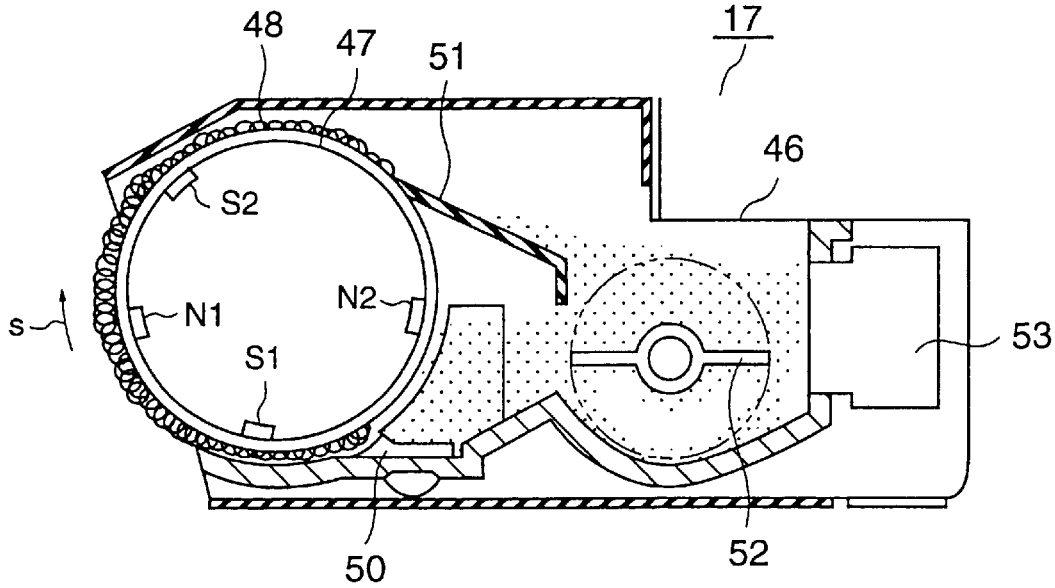
FIG. 15 is an explanatory diagram briefly showing the ready to developing state of the two-component developing device in a comparison example.
Figure 16:
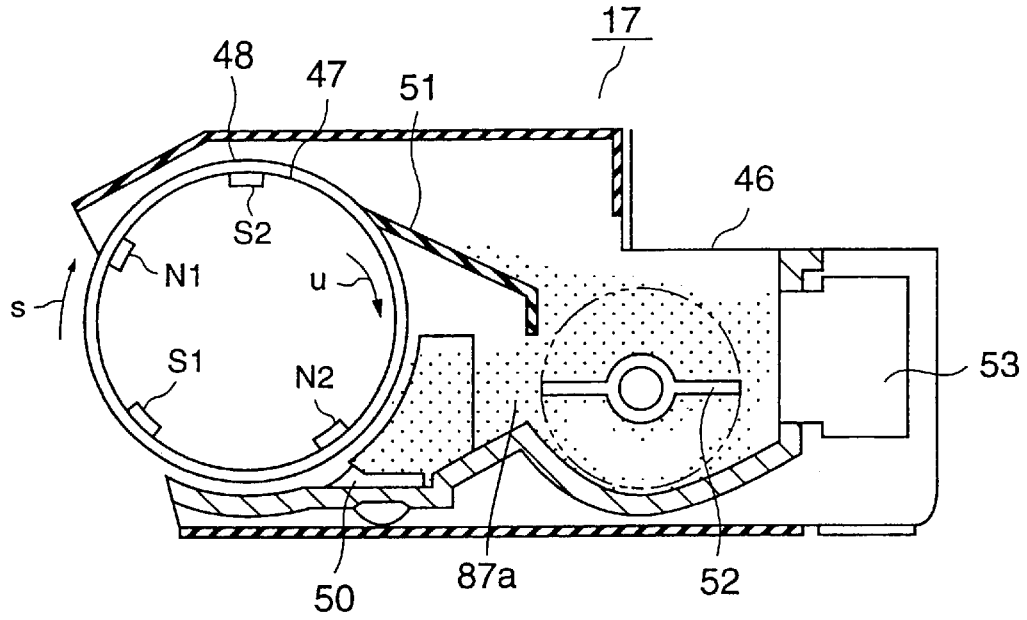
FIG. 16 is an explanatory diagram briefly showing the non-developing state of the two-component developing device in the comparison example.

On the contrary to this, when the two-component developing device 17 was switched to the ready to developing state or the non-developing state by shifting the rotating direction of the magnet roller 47 in the developing sleeve 48 using the two-component developing device used in the first embodiment as a comparison example, a clear image couldn't be obtained and the image deterioration for mixing of different color toners was caused. In this comparison example, the two-component developing device 17 used in the fist embodiment is arranged stationary in the developing area of the photosensitive belt 12, the developing sleeve 48 is rotated in the arrow direction s to form a developer layer around the developing sleeve 48, the thickness of this developer layer is controlled by the doctor blade 50 and the two-component developing device 17 is placed in the ready to developing state as shown in FIG. 15. After completing the development, rotate the magnet roller 47 in the arrow direction u until the permanent magnet N2 comes to the position of the doctor blade 50. This is to form a developer barrier between the permanent magnet N2 and the doctor blade 50 to shut off the developer layer around the developing sleeve 48, recover the developer layer on the developing sleeve 48 in the housing 46, place the two-component developing device 17 in the non-developing state, thereby preventing mixing of colors of toner images.

However, in this comparison example, as the two-component developing device 17 was switched to the ready to developing state or the non-developing state by mechanically rotating the magnet roller 47, a time was needed for the switching and this comparison example was not suited for a color image forming apparatus using four developing devices of the one-component developing devices 16Y–16C and the two-component developing device 17 by switching them successively at a high speed and caused color mixture.

According to the third embodiment as described above, likewise the first embodiment described above, the image forming apparatus of the present invention is capable of forming color images without deteriorating the user's maintainability required preferentially as a color image forming apparatus and is also usable as a monochrome image forming apparatus for forming monochrome images at a cheap cost at the same level as a conventional exclusive monochrome image forming apparatus by using a two-component developing device when forming monochrome images. Accordingly, a single unit of the image forming apparatus 10 provides the monochrome image forming function as well as the color image forming function at a cost almost equivalent to a conventional cost.

According to the third embodiment, likewise the first embodiment, a good developing characteristic is obtained as the developing gap is stabilized and also, a good image without uneven density is obtained because the developing position of the two-component developing device 82 becomes an area wherein the photosensitive belt 12 does not flutter.

According to the third embodiment, only by turning the switch 86 ON/OFF, which applies electric charge to the electromagnet N3, it is possible to rapidly and easily switch the two-component developing device 82 to the ready to developing state or the non-developing state by switching the surface magnetic flux density of the electromagnet N3 instantaneously, surely prevent mixing of toner colors and obtain an developed image of clear and good quality.

Next, a fourth embodiment of the present invention will be described. In this fourth embodiment, the magnet roller is in a structure differing from that in the third embodiment and further, the switching method of the electromagnet also differs from that in the third embodiment. Accordingly, in this fourth embodiment, the same elements as those described in the third embodiment will be assigned with the same reference numerals and the detailed explanation of them will be omitted.

Figure 17:
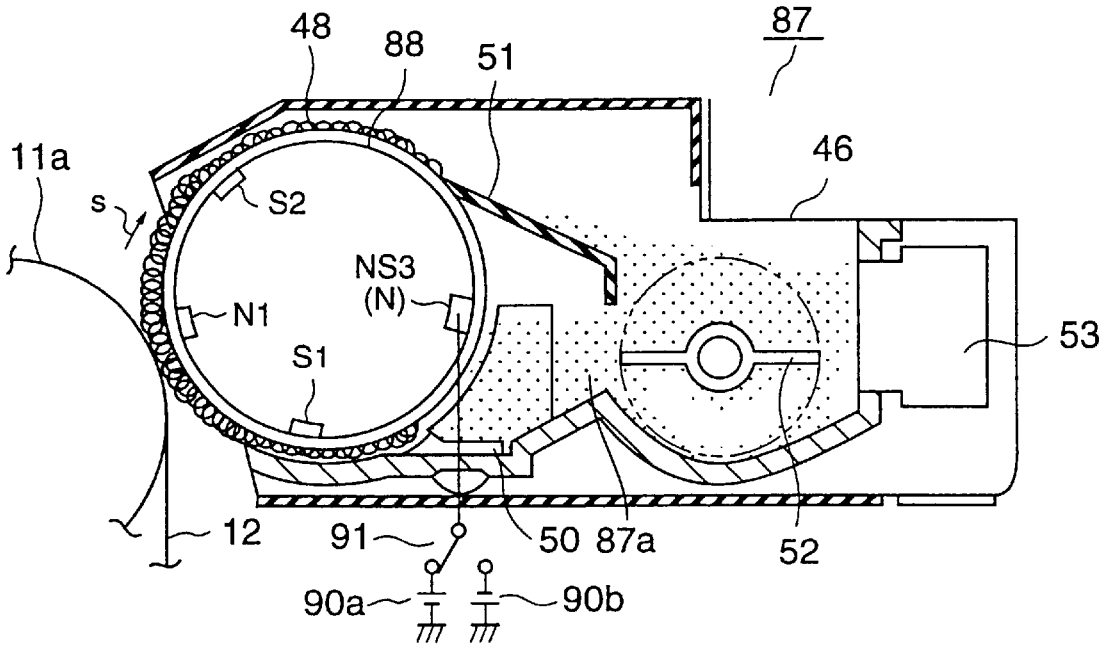
FIG. 17 is an explanatory diagram briefly showing the ready to developing state of the two-component developing device in a fourth embodiment of the present invention.
Figures 18, 19:
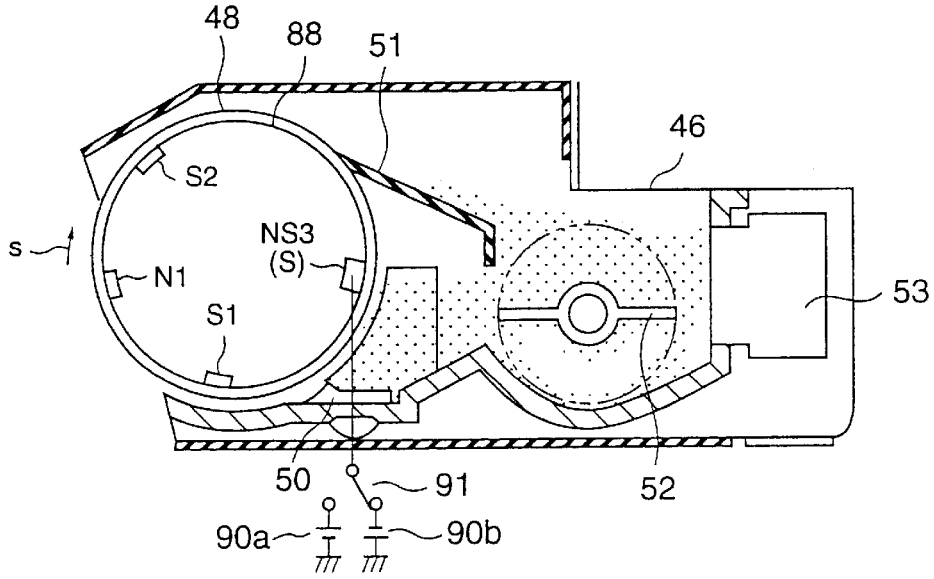
FIG. 18 is Table 4 showing the arrangement and magnetic flux density of a magnet of the magnet roller in the fourth embodiment of the present invention.
FIG. 19 is an explanatory diagram briefly showing the non-developing state of the two-component developing device in the fourth embodiment of the present invention.

A two-component developing device 87 shown in FIG. 17, that is filled with a two-component developer 87*a* comprising a magnetic carrier and a non-magnetic black (K) toner, which is a two-component developer, is supported by the driving roller 11*a* and is opposed to the photosensitive belt 12 in the area wherein it does not flutter likewise the two-component developing device 82 in the third embodiment. The two-component developing device 87 is stationary arranged at the position opposing to the photosensitive belt 12 by holding a developing gap between the developing sleeve 48 and the photosensitive belt 12 at 0.04 mm. A magnet roller 88 of the two-component developing device 87 has permanent magnets N1 (the main polarity), S2 and S1 each of which has an arranged angle and a surface magnetic flux density shown in (Table 4) in FIG. 18, and between the permanent magnets S2 and S1, there is a electromagnet NS3 that is able to switch and control the surface magnetic flux density to N polarity 400 (mT) or S polarity 400 (mT) as shown in (Table 4).

To place the two-component developing device 87 in the ready to developing state, turn a switch 91 for switching a plus applying power source 90*a* or a minus applying power source 90*b* to the plus applying power source 90*a* side and set the surface magnetic flux density of the electromagnet NS3 at N polarity 400 (mT). When the developing sleeve 48 is driven in the arrow direction s under this state, a developer layer comprising the two-component developer 87*a* is formed on the developing sleeve 48 as shown in FIG. 17 and the thickness of the developer layer is controlled by the doctor blade 50. When setting the two-component developing device 87 in the non-developing state, turn the switch 91 to the minus applying power source 90*b* side and set the surface magnetic flux density of the electromagnet NS3 to S polarity 400 (mT). Then, by shutting off the magnetic flux line around the magnet roller 88 between the permanent magnets S2 and S1, recover the developer layer from the developing sleeve 48 into the housing 46.

If a black (K) toner image forming is needed when forming a color image or a monochrome image, separate the developing rollers 34Y–34C of the one-component developing devices 16Y–16C from the photosensitive belt 12. In the case of the two-component developing device 87, turn the switch 91 to the plus applying power source 89*a* side, set the surface magnetic flux density of the electromagnet NS3 to 400 (mT) and make the magnetic flux line around the magnet roller 88 continuous. Further, by rotating the developing sleeve 48 in the arrow direction s, form a developer layer around the developing sleeve 48 and control the layer thickness by the doctor blade 50. Form the developing nip for the developing gap between the developing sleeve 48 and the photosensitive belt 12 by the developer layer on the developing sleeve 48 and place the two-component developing device 87 in the ready to developing state. A latent image on the photosensitive belt 12 is developed while it passes through the developing gap between the developing sleeve 48 and the photosensitive belt 12 and a black toner image is formed on the photosensitive belt 12.

After completing the development, first turn the switch 91 to the minus applying power source 90*b* side, reverse the surface magnetic flux density of the electromagnet NS3 to S polarity 400 (mT), shut off the magnetic flux line between the permanent magnets S2 and S1, immediately recover the developer layer on the developing sleeve 48 in the housing 46, place the two-component developing device 87 in the non-developing state and thereafter, stop the developing sleeve 48 to prevent mixing of toner image colors.

According to the fourth embodiment, likewise the third embodiment described above, the image forming apparatus of the present invention is capable of forming color images without deteriorating the usr maintainability required preferentially as a color image forming apparatus and is also usable as a monochrome image forming apparatus for forming monochrome images at a cheap cost at the same level as a conventional exclusive monochrome image forming apparatus by using a two-component developing device when forming monochrome images. Accordingly, a single unit of the image forming apparatus 10 provides the monochrome image forming function as well as the color image forming function at a cost almost equivalent to a conventional cost.

According to this fourth embodiment, as the image development is made by the two-component developing device 87 in an area wherein the photosensitive belt 12 does not flutter, likewise the third embodiment, a good developing characteristic as well as a good image are obtained as the developing gap is stabilized.

According to this fourth embodiment, the two-component developing device 87 can be switched into the ready to developing state or the non-developing state rapidly and easily by switching the surface magnetic flux density of the electromagnet NS3 to N polarity or S polarity in a moment by switching the charging polarity to be applied to the electromagnet NS3 only by controlling the switching of the switch 91, and the mixing of toner colors can be surely prevented and a clear developed image of good quality is obtained.

Further, the application of the present invention is not restricted to the above embodiments but can be varied variously within the scope of the invention. For example, when the two-component developing device is not displaced for the fluttering of the photosensitive belt, etc., its arranging position can be in an area wherein the back of the photosensitive belt is supported by other driven rollers or not restricted to rollers but other stationary supporting members.

The width, etc. of the developing gap at the development by the two-component developing device is also not restricted and the arrangement and magnetic flux density of permanent magnets and electromagnets of the magnet rollers are also optional if the two-component developing device is capable of switching the reading to developing state or the non-developing state. Further, toners that are two-component developers used by the two-component developing device can be either magnetic toner or non-magnetic toner. In addition, the structure of the image forming apparatus is also optional and without using an intermediate transferring drum, toner images in respective colors may be transferred directly on a recording paper, etc. from an image carrier and color images can be superposed on a recording paper.

As described above in detail, according to the present invention, an image forming apparatus equipped with plural one-component developing devices having different color toners for forming a color image is provided with a two-component developing device for forming a black (K) toner image and when forming monochrome images, they are developed using the two-component developing device of which developing cost per image is cheap and a monochrome image can be obtained at a low cost almost equal to that of a conventional monochrome only image forming apparatus without deteriorating user maintainability demanded preferentially for a color image forming apparatus, and a color image forming apparatus corresponding to color images is also usable as a monochrome image forming apparatus. Accordingly, even in offices having narrow spaces, without a need for additionally installing a color image forming apparatus, a color image forming function can be obtained from one unit of image forming apparatus in addition to a conventional monochrome image forming function and a color corresponding image forming apparatus can be introduced easily and the further wide spread of a color image forming apparatus can be achieve.

Further, according to the present invention, a minute developing gap between the image carrier and the two-component developing device can be satisfactorily maintained and a good developed image is obtained without producing uneven image density caused by the displacement of the developing gap by forming a black developed image by the two-component developing device in an area wherein the image carrier is not displaced.

Further, according to the present invention, when developing an image by other one-component developing devices, the two-component developing device can be controlled to the non-developing state, mixture of toner colors is prevented and a clear and satisfactorily developed image is obtained.

What is claimed is:

1. An image forming apparatus comprising:

an image carrier that travels endlessly;

plural supporting members supporting the image carrier so that it is able to travel;

a latent image forming portion for forming a latent image on the image carrier;

a first developing device having first developing members that contact the image carrier after passing the latent image forming portion and form a developed image by supplying developers to the latent image; and a second developing device having a second developing member that is facing the image carrier after passing the latent image forming portion with a prescribed gap and forming a developed image by supplying developers to the latent image;

wherein the first developing device is a non-magnetic one-component contact developing device having non-magnetic one-component developer, and the second developing device is a two-component developing device having two-component developer.

2. An image forming apparatus according to claim 1, wherein the second developing device is provided facing the image carrier at a position supported by one of the plural supporting members.

3. An image forming apparatus according to claim 2, wherein the latent image forming portion forms latent images in respective colors in order on the image carrier;

the first developing device is provided in plural units and in plural colors, and according to a color of a latent image, only one of the first developing members of the first developing device contacts the image carrier; and the two-component developer is black and when the latent image is black, the second developing device supplies the black two-component developer to the image carrier.

4. An image forming apparatus according to claim 3, wherein the first developing device is provided in at least 3 units for each of yellow, magenta and cyan non-magnetic one-component developers.

5. An image forming apparatus according to claim 2, wherein the supporting members are rollers, the first developing members are provided so as to contact the image carrier at positions between rollers, and the second developing member is provided facing the image carrier in an area supported by a roller.

6. An image forming apparatus according to claim 5, wherein the latent image forming portion forms latent images in respective colors on the image carrier;

the first developing device is provided in plural units for respective color developers and only one of the first developing member of the first developing device contacts the image carrier; and the two-component developer is black and when the latent image is black, the second developing member supplies the black two-component developer to the image carrier.

7. An image forming apparatus according to claim 6, wherein the first developing device is provided in at least 3 units for yellow, magenta and cyan non-magnetic one-component developers, respectively.

8. An image forming apparatus comprising:

a belt-shaped photo-conductor;

plural roller members supporting the photo-conductor so that it is able to travel;

a latent image forming portion for forming a latent image on the photo-conductor;

a non-magnetic one-component contact developing device having a first developing member for forming a developing image by supplying non-magnetic one-component developer to the latent image by contacting the photo-conductor after passing the latent image forming portion; and a two-component developing device having a second developing member that is facing to the photo-conductor at a prescribed gap in an area supported by one of the plural roller members after passing the latent image forming portion for forming a developing image by supplying two-component developer to the latent image.

9. An image forming apparatus according to claim 8, wherein the roller member facing to the second developing member has a first positioning member, and the second developing member has a second positioning member, and the first and second positioning members are always kept in contact with each other and by rotating at least either one of them, a gap between the photo-conductor and the second developing member is adjusted to a gap wider than the prescribed gap.

10. An image forming apparatus according to claim 9, wherein the first positioning member has a first reference plane and a cam member that rotates on the same axis with the roller member; and a gap between the photo-conductor and the second developing member is adjusted to the prescribed gap by the contact of the second positioning member with the first reference plane.

11. An image forming apparatus according to claim 10, wherein the latent image forming portion forms latent images in respective colors on the photo-conductor in order, the one-component contact developing device is provided in plural units for each color and only one of the first developing member of the one-component contact developing device contacts the photo-conductor according to the color of the latent image, the two-component developer is black and when the latent image is black, the second developing member supplies the black two-component developer to the photo-conductor.

12. An image forming apparatus according to claim 11, wherein the one-component contact developing device is provided at least in 3 units for yellow, magenta and cyan non-magnetic one-component developers.

13. An image forming apparatus according to claim 9, wherein the second positioning member has a reference plane and a cam member rotating on the same axis with the second developing member, and the gap between the photo-conductor and the second developing member is adjusted to the prescribed gap by the contact of the first positioning member with the reference plane.

14. An image forming apparatus according to claim 13, wherein the latent image forming portion forms latent images in respective colors on the photo-conductor in order, and the one-component contact developing device is provided in plural units for each color and only one of the first developing member of the one-component contact developing device contacts the photo-conductor according to the color of the latent image, the two-component developer is black and when the latent image is black, the second developing member supplies the black two-component developer to the photo-conductor.

15. An image forming apparatus according to claim 14, wherein the one-component contact developing device is provided at least in 3 units for yellow, magenta and cyan non-magnetic one-component developers.

16. An image forming apparatus according to claim 8, wherein the second developing member comprises a magnet roller including plural permanent magnets and at least one electromagnet, and a developing sleeve that is able to rotate around the magnet roller, and by controlling ON-OFF of electric charge to be applied to the electromagnet, controls to the state with a developer layer formed around the developing sleeve or the state without the developer layer formed.

17. An image forming apparatus according to claim 16, wherein the latent image forming portion forms latent images in respective colors on the photo-conductor in order, the one-component contact developing device is provided in plural units for each color and only one of the first developing member of the one-component contact developing device contacts the photo-conductor according to the color of the latent image, the two-component developer is black and when the latent image is black, a developer layer is formed around the developing sleeve.

18. An image forming apparatus according to claim 17, wherein the one-component contact developing device is provided at least in 3 units for yellow, magenta and cyan non-magnetic one-component developers, respectively.

19. An image forming apparatus according to claim 8, wherein the second developing member comprises a magnet roller including plural permanent magnets and at least one electromagnet, and a developing sleeve that is able to rotate around the magnet roller, and by controlling ON-OFF of electric charge to be applied to the electromagnet, controls to the state with a developer layer formed around the developing sleeve or the state without the developer layer formed.

20. An image forming apparatus according to claim 19, wherein the latent image forming portion forms latent images in respective colors on the photo-conductor in order, the one-component contact developing device is provided in plural units for each color and only one of the first developing member of the one-component contact developing device contacts the photo-conductor, the two-component developer is black and when the latent image is black, a developer layer is formed around the developing sleeve.

21. An image forming apparatus according to claim 20, wherein the one-component contact developing device is provided in 3 units for yellow, magenta and cyan non-magnetic one-component developers, respectively.

22. An image forming apparatus comprising:

an image carrier that travels endlessly;

a latent image forming portion for forming a latent image on the image carrier;

a non-magnetic one-component contact developing device having first developing members that contact the image carrier after passing the latent image forming portion and form a developed image by supplying non-magnetic one-component developers to the latent image; and two-component developing device having a second developing member that is facing the image carrier after passing the latent image forming portion with a prescribed gap and forming a developed image by supplying two-component developer to the latent image.

23. An image forming apparatus according to claim 22, wherein the latent image forming portion forms latent images in respective colors in order on the image carrier;

the non-magnetic one-component contact developing device is provided in plural units and in plural colors, and according to a color of a latent image, only one of the first developing members of the non-magnetic one-component contact developing device contacts the image carrier; and the two-component developer is black and when the latent image is black, the two-component developing device supplies the black two-component developer to the image carrier.

24. An image forming apparatus according to claim 23, wherein the non-magnetic one-component contact developing device is provided in at least 3 units for each of yellow, magenta and cyan non-magnetic one-component developers.

* * * * *